United States Patent [19]

Koo

[11] 4,090,105

[45] May 16, 1978

[54] HIGH INTENSITY DISCHARGE LAMP WITH MULTIPLE FILAMENT TO EXTINGUISH LAMP WHEN OUTER ENVELOPE BREAKS

[75] Inventor: Ronald C. Koo, Upper Montclair, N.J.

[73] Assignee: Duro-Test Corporation, North Bergen, N.J.

[21] Appl. No.: 677,267

[22] Filed: Apr. 15, 1976

[51] Int. Cl.[2] ..... H01J 7/44; H05B 41/231

[52] U.S. Cl. ..... 315/74; 313/25

[58] Field of Search ..... 315/74, 75, 58, 49, 315/67, 69; 313/25, 184; 339/290, 293

[56] References Cited

U.S. PATENT DOCUMENTS

| | | | |
|---|---|---|---|
| 462,452 | 11/1891 | Rice, Jr. | 337/290 |
| 1,889,585 | 11/1932 | Zodrow et al. | 337/293 |
| 2,203,550 | 6/1940 | Spanner | 315/49 |

FOREIGN PATENT DOCUMENTS

| | | | |
|---|---|---|---|
| 630,536 | 5/1936 | Germany. | |
| 1,051,948 | 12/1966 | United Kingdom. | |
| 267,753 | 7/1970 | U.S.S.R. | 315/74 |

*Primary Examiner*—Palmer C. Demeo
*Attorney, Agent, or Firm*—Darby & Darby

[57] ABSTRACT

A high intensity discharge lamp in which the arc tube is located within an outer envelope. A multi-filament assembly is located within the outer envelope in series with the current supply to the arc tube. When the lamp outer envelope is broken, the filaments will burn out in the presence of air, open the current supply to the arc tube and extinguish the arc. The use of multi-filaments permits better control of the filament burn out time.

11 Claims, 1 Drawing Figure

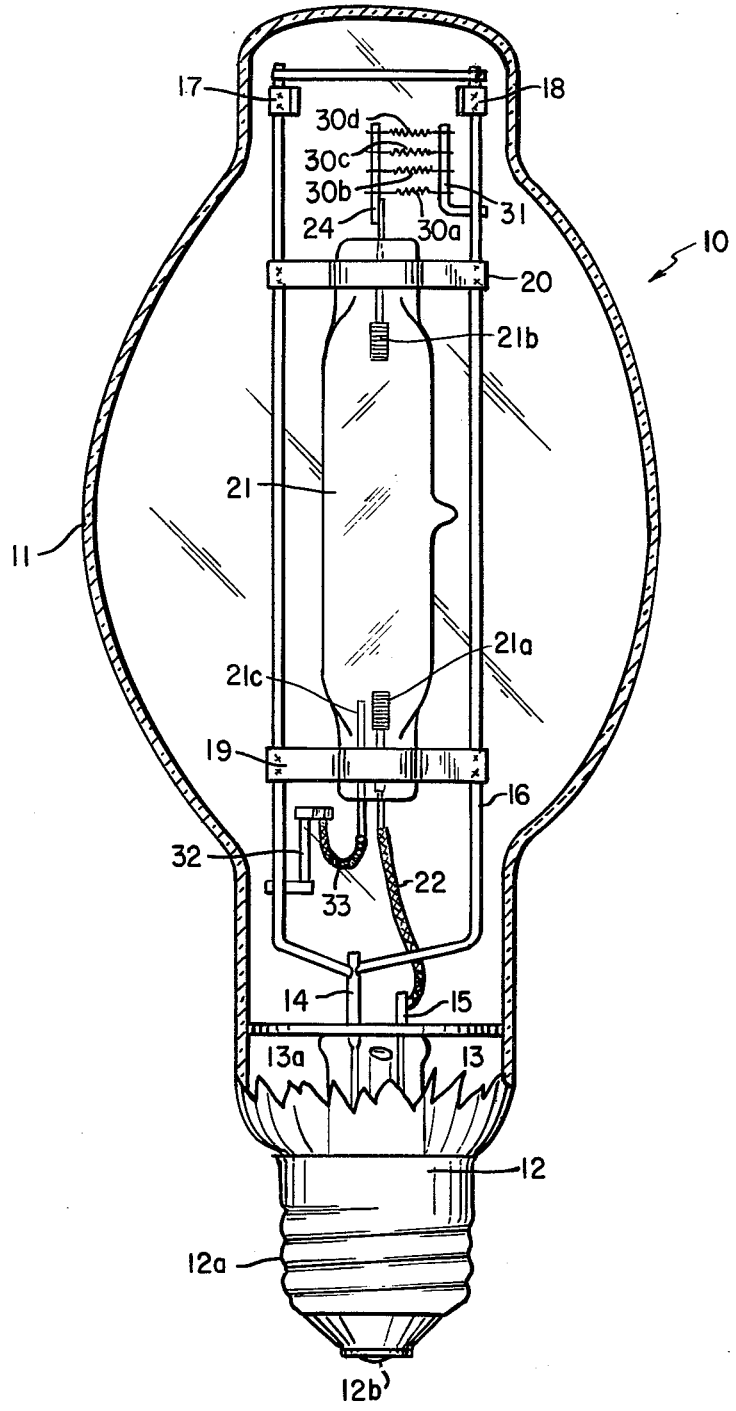
17
18
30d
30c
30b
31
24
30a
10
20
21b
21
11
21a
21c
19
16
32
22
33
14
15
13a
13
12
12a
12b

HIGH INTENSITY DISCHARGE LAMP WITH MULTIPLE FILAMENT TO EXTINGUISH LAMP WHEN OUTER ENVELOPE BREAKS

In U.S. patent application Ser. No. 577,096 filed May 13, 1975 in the names of Herbert S. Strauss and Lawrence Sheinberg, which is assigned to the assignee of the subject application, a high intensity arc discharge (HID) lamp is disclosed in which an arc tube, for example of the mercury vapor type, is located within an outer glass envelope. A single incandescible filament, for example of tungsten, acting as an oxidizable switching element is incorporated electrically in series with the current supply to the arc tube and is physically located between the outer glass envelope and the inner arc tube. During normal lamp operation the filament is heated to incandescence and does not detract significantly from the operation of the arc tube. If the outer glass envelope is broken, such as by accident or other cause, the filament is exposed to air and burns out within a relatively short time due to oxidation in air. This breaks the electrical current supply to the arc tube, and consequently extinguishes the arc tube. In a situation where the outer envelope is broken, it is desired to rapidly extinguish the arc to prevent possible erythemal damage to the eyes or skin of a person. The reason why this is necessary is because the outer envelope normally blocks harmful radiation. Without this envelope, the harmful radiation can adversely affect the human body.

The design of the filament used as a fuse in the aforesaid lamp, or any other safety device, must satisfy the following major requirements:

1. It must exhibit sufficiently long life reliably such that it will not limit the lamp life so long as the outer glass envelope remains unbroken.

2. The time required to extinguish the arc tube after the outer glass envelope is broken, that is, the burn out time of the filament, should be relatively short. A limit of two minutes, or perhaps less, as recently been suggested by the Bureau of Radiological Health of the United States Food and Drug Administration.

3. The safety device must also operate if the lamp is switched on after the outer glass envelope is broken.

Tests have shown that in certain operating conditions of an HID lamp, the use of a single filament as a switching element does not always satisfy the above-mentioned requirements simultaneously, although the basic concept is sound. This is due to the fact that in designing the filament a compromise must be reached between long life and short burn-out time, since both filament life and burn-out time decrease with increasing filament temperature.

In a typical filament design a wire of relatively large diameter must be used to withstand the high transient current occurring when the lamp is switched. For example, a 400 watt lamp requires a wire diameter of more than 0.009 inch in order to sustain the high current without limiting the filament life. With filaments of this large diameter, burn-out times have been encountered of a duration greater than two minutes.

The present invention relates to an improvement in an HID lamp of the foregoing type in which an incandescible element, such as a filament, is used as an oxidizable switching element to extinguish the arc tube when the outer envelope is broken. In accordance with the invention the element is formed by a plurality (N) of filaments which are preferably connected in parallel. Each filament carries 1/N of the total lamp current.

Since the current carrying capacity of each filament is reduced, its wire size diameter also can be reduced. The optimum number of filaments is selected for a given lamp so that the filament wire diameter will be such to operate at a relatively low temperature, thereby increasing filament life. The use of a smaller diameter filament ensures a more rapid burn out when the outer envelope breaks and the filament is exposed to air.

It is therefore an object of the present invention to provide a high intensity discharge lamp of the type having an arc discharge tube within an envelope in which means are provided in the envelope to extinguish the arc when the envelope is broken.

An additional object is to provide a high intensity discharge lamp having a switching element in the form of a plurality of parallel connected filaments which burn out and remove the current from the arc discharge tube when the lamp outer envelope is broken.

A further object is to provide a high intensity discharge lamp having a plurality of parallel connected filaments in series with the current supply to the arc discharge lamp in which the filaments burn out rapidly to remove the current when the lamp outer envelope breaks.

Other objects and advantages of the present invention will become more apparent upon reference to the following specification and annexed drawings in which the single FIGURE is an elevational view of a preferred embodiment of lamp according to the invention.

FIG. 1 shows a typical 400 watt mercury HID lamp 10 incorporating the fusible element for extinguishing the arc discharge. The lamp 10 includes a generally tubular outer envelope 11 having a bulbous central portion with a conventional base 12 attached to the bottom. Extending inwardly from the base 12 and inside of the envelope 11 is a stem 13 having a tubulation **13*a* and a pair of stiff lead-in wires 14 and 15 in electrical conducting relation with the respective contact portions 12*a* and 12*b* of base 12**.

Welded to the lead-in wire 14 is a generally rectangular arc tube mounting frame wire 16. Two springs 17 and 18 are welded to the frame wire 16 near its top to give strength to the completed mount within the envelope 11. The springs have legs (not shown) which contact the inner surface of the envelope. Two arc tube supports 19 and 20 of metal material are welded across the frame wire 16 and support a conventional quartz arc tube 21 at its flattened ends.

For purposes of description, it is considered that the arc tube is of the mercury vapor type although the invention will operate with other types of arc discharge tubes with different radiation spectra, for example, high pressure sodium and metal halide lamps. Arc tube 21 contains the usual main electrodes **21*a* and 21*b* and starting electrode 21*c*. One main electrode lead wire 22 of the quartz arc tube 21 is welded to lead-in wire 15. The other main electrode lead wire 23 is welded to a stiff filament lead wire clamp 24**.

Arc tube 21 also contains the discharge medium, mercury in the example being described. The appropriate medium would be used for other types of lamps. A typical operating pressure in the arc tube is about 4 Atmospheres and in the outer envelope about 800 Torr.

A filament assembly 30 is located between clamp 24 and a filament clamp 31 which is welded to frame wire 16. Filament assembly 30 is formed by a plurality (N) of incandescent filaments, here illustratively shown as four, **30*a*, 30*b*, 30*c* and 30*d*. A starting resistor 32 has one end welded to frame wire 16 and to a starting electrode lead wire 33**.

The lamp operates in the following manner. When voltage is applied to lead-in wires 14 and 15 through the proper ballast (not shown), voltage is applied to main electrode 21*a* over wire 22 and to the starting electrode 21*c* from lead-in 14, frame 16, starting resistor 32 and lead 33. The other main electrode 21*b* receives voltage over lead-in 14, frame 16, clamp 31, filament assembly 30, and clamp 24. The arc will be struck in the arc tube in the usual manner and current will flow. After a period of time, as the mercury vapor pressure increases in the arc tube, the arc tube voltage will increase.

The lamp operates in the normal manner in that the arc discharge produces radiation both in the visible and invisible ranges, the latter including ultraviolet radiation in the potentially harmful range of 200–297 nm. This potentially harmful radiation is normally blocked by the outer envelope 11 whose material, for example a special glass, is capable of doing this.

If for some reason the outer bulb 11 breaks, for example, because it is struck by an object, the filaments of assembly 30 are now burning in air. They oxidize rapidly and burn through. This interrupts the circuit supplying current to electrode 21*b* and causes the discharge tube 21 to extinguish. Of course, once the arc extinguishes no more radiation is produced by the lamp and no harm can come to any person in the vicinity of the lamp.

Due to normal manufacturing and material tolerances, one of the filaments 30*a*–30*d* would burn out first. This increases the current through the remaining filaments causing the next one to burn out. This action continues until all of the filaments burn out to open the circuit. The burn out time is quite rapid due to the fact that the filaments are selected for optimum (fastest) burn out time consistent with good lamp operating performance.

Each filament of the assembly 30 preferably carries 1/N of the total lamp current, where N is the number of filaments in parallel. The optimum number of filaments is to be chosen for a given lamp on the basis that each of the filament wire diameters, where tungsten wire is used, preferably will be in the range of from about 0.0015 to 0.0025 inches in diameter and preferably about 0.002 inch in diameter so that the operating temperature of all the filaments will be in the range of 1000°–1400° C. In spite of the low temperature, the filament will still burn-out within seconds upon exposure to air because of the smallness of its diameter. The filaments can be of the coiled or coiled-coil type. If desired, one or more of the filaments of the assembly can be specially constructed, for example, by changing the wire diameter, so that the current carrying distribution as between the filaments can be made different.

The use of multiple filaments offers an additional advantage in reliability. Premature lamp failure due to defective filaments is minimized, since it is unlikely that all filaments in parallel fail simultaneously. That is, each filament of the assembly is capable of operating in the environment with the envelope unbroken even though one or more of the other filaments has burned out. Of course, as one filament of the assembly burns out, an increased load is placed on the remaining filaments and their lives will be shortened somewhat.

As explained in the aforesaid copending application of Strauss and Sheinberg, a thermostatic switch can be used in parallel with the filament assembly 30 to place the filaments out of the circuit during normal operation of the lamp. The thermostatic switch opens when the outer envelope is broken due to a decrease in operating temperature.

The use of one or more filaments as the oxidizable switching element also is advantageous since the element will operate to extinguish the arc even when only a part of the outer envelope is broken. That is, any break in the envelope, through which the harmful radiation can pass, will admit air to the filament(s) resulting in burnout.

What is claimed is:

1. An arc discharge type electric lamp comprising:

an envelope, arc tube means within said envelope including electrodes and an ionizable medium for producing a discharge including radiation in the visible and invisible range upon the application of current thereto, means for supplying current to said arc tube means to produce said discharge and current interrupting means within said envelope in series with the current supply means and said arc tube means, said current interrupting means comprising a plurality of resistively heated, oxidizable, incandescible filaments electrically connected in parallel and capable of carrying the lamp current under normal starting and operating conditions having substantially no ballast current control function with respect to the current supplied to the arc tube means, said filaments when carrying the lamp current oxidizing upon exposure to air after breaking of the envelope and oxidizing through and breaking to remove the current supply from the arc tube to extinguish the discharge.

2. An electric lamp as in claim 1 wherein each of the filaments of the assembly carries substantially the same proportion of the current to the arc tube.

3. An electric lamp as in claim 1 wherein at least one of the filaments of the assembly carries a current different from that of the other filaments.

4. An electric lamp as in claim 1 wherein at least some of the filaments of the assembly are of tungsten wire.

5. An electric lamp as in claim 1 wherein filaments of the assembly have an operating temperature in the range of from about 1000° to about 1400° C.

6. An electric lamp as in claim 1 wherein at least one of the filaments of the assembly comprises a wire having a diameter in the range of from about 0.0015 to about 0.0025 inches.

7. An electric lamp as in claim 6 wherein all of the filaments of the assembly comprise a wire having a diameter in the range of from about 0.0015 to 0.0025 inches.

8. An electric lamp as in claim 5 wherein the filaments are of tungsten wire.

9. An electric lamp as in claim 6 wherein at least one filament is of tungsten wire.

10. An electric lamp as in claim 7 wherein all of said filaments are of tungsten wire.

11. An arc discharge type electric lamp as set forth in claim 1 wherein a number of said filaments less than said plurality of filaments will carry the lamp current under normal starting and operating conditions when said outer envelope is intact.

* * * * *